US009358559B2

(12) United States Patent
Kosaka et al.

(10) Patent No.: US 9,358,559 B2
(45) **Date of Patent: *Jun. 7, 2016**

(54) SPRAY GUN

(71) Applicant: Anest Iwata Corporation, Yokohama-shi, Kanagawa (JP)

(72) Inventors: Shozo Kosaka, Yokohama (JP); Masaru Kaneko, Fujisawa (JP); Nobuyoshi Morita, Yokohama (JP); Takayuki Hata, Yokohama (JP); Atsushi Morohoshi, Yokohama (JP); Nobuhiro Sawata, Yokohama (JP)

(73) Assignee: ANEST IWATA CORPORATION, Yokohama (JP)

( * ) Notice: Subject to any disclaimer, the term of this patent is extended or adjusted under 35 U.S.C. 154(b) by 79 days.

This patent is subject to a terminal disclaimer.

(21) Appl. No.: 13/687,570

(22) Filed: Nov. 28, 2012

(65) Prior Publication Data

US 2014/0061336 A1 Mar. 6, 2014

(30) Foreign Application Priority Data

Aug. 31, 2012 (JP) ..... 2012-192467

(51) Int. Cl.
*B05B 1/28* (2006.01)
*B05B 7/06* (2006.01)
(Continued)

(52) U.S. Cl.
CPC ..... *B05B 7/066* (2013.01); *B05B 7/0815* (2013.01); *B05B 1/3046* (2013.01)

(58) Field of Classification Search
CPC .... B05B 1/3046; B05B 7/066; B05B 7/0815; B05B 7/12; B05B 9/01; B05B 12/002
USPC ..... 239/292, 296–301, 407, 408, 413–415, 239/416, 416.4–417.5, 418, 420, 239/423–424.5, 526
See application file for complete search history.

(56) References Cited

U.S. PATENT DOCUMENTS 1,751,787 A 3/1930 Binks
2,646,314 A 7/1953 Peeps
(Continued)

FOREIGN PATENT DOCUMENTS

EP 0 092 392 A2 10/1983
EP 0 650 766 B1 4/1999
(Continued)

OTHER PUBLICATIONS

Extended European Search Report issued in European Patent Application No. 13182003.7 dated Dec. 10, 2013.
(Continued)

*Primary Examiner* — Christopher Kim
(74) *Attorney, Agent, or Firm* — Oliff PLC

(57) ABSTRACT

A spray gun including: a body having a gun barrel; a coating material nozzle disposed on a tip end side of the gun barrel, and an air cap disposed on the tip end side of the gun barrel to surround a tip end portion of the coating material nozzle, wherein the tip end portion of the coating material nozzle has on the tip end surface thereof a guide wall spreading, and also has on the outer peripheral surface thereof a plurality of V-shaped grooves channeled in a longitudinal direction, and wherein the V-shaped groove has, in a triangle shaped cross section defined by contours crossing the guide wall, a height in the range of 0.5 mm to 2.5 mm and an opening angle of a bottom vertex in the range of 20 degrees to 100 degrees.

6 Claims, 12 Drawing Sheets

(51) Int. Cl.

| | |
|---|---|
| ***B05B 7/08*** | (2006.01) |
| *B05B 1/30* | (2006.01) |

(56) References Cited

U.S. PATENT DOCUMENTS

| | | | | |
|---|---|---|---|---|
| 3,583,632 | A | 6/1971 | Shaffer et al. | |
| 3,746,253 | A | 7/1973 | Walberg | |
| 3,747,850 | A | 7/1973 | Hastings et al. | |
| 3,857,511 | A | 12/1974 | Govindan | |
| 3,873,023 | A | 3/1975 | Moss et al. | |
| 4,273,293 | A | 6/1981 | Hastings | |
| 4,884,742 | A | 12/1989 | Bekius et al. | |
| 5,064,119 | A | 11/1991 | Mellette | |
| 5,078,323 | A | 1/1992 | Frank | |
| 5,080,285 | A | 1/1992 | Toth | |
| 5,088,648 | A | 2/1992 | Schmon | |
| 5,090,623 | A | 2/1992 | Burns et al. | |
| 5,249,746 | A | 10/1993 | Kaneko et al. | |
| 5,344,078 | A | 9/1994 | Fritz et al. | |
| 5,435,491 | A | 7/1995 | Sakuma | |
| 5,456,414 | A | 10/1995 | Burns et al. | |
| 5,540,385 | A | 7/1996 | Garlick | |
| 5,607,108 | A | 3/1997 | Garlick et al. | |
| 5,613,637 | A | 3/1997 | Schmon | |
| 5,941,461 | A | 8/1999 | Akin et al. | |
| 5,992,763 | A | 11/1999 | Smith et al. | |
| 6,494,387 | B1 * | 12/2002 | Kaneko | 239/296 |
| 6,708,900 | B1 | 3/2004 | Zhu et al. | |
| 7,163,160 | B2 | 1/2007 | Liu | |
| 8,225,892 | B2 | 7/2012 | Ben-Tzvi | |
| 2005/0145718 | A1 | 7/2005 | Blette et al. | |

FOREIGN PATENT DOCUMENTS

| | | | |
|---|---|---|---|
| EP | 0 650 766 B1 | B1 | 4/1999 |
| EP | 1 108 476 | | 6/2001 |
| JP | S58-119862 | U | 8/1983 |
| JP | S6155951 | U | 4/1986 |
| JP | H0177863 | U | 5/1989 |
| JP | H06-304501 | A | 11/1994 |
| JP | A-8-196950 | | 8/1996 |
| JP | 2002-001169 | A | 1/2002 |
| JP | 2010-502419 | A | 1/2010 |
| JP | 2014-033993 | A | 2/2014 |
| WO | WO 01/02099 | A1 | 1/2001 |
| WO | 2008/029229 | A1 | 3/2008 |

OTHER PUBLICATIONS

Jul. 24, 2013 Declaration of Robert R. Lacovara Exhibit 2002 in IPR2013-00111.
Sep. 25, 2013 Proposed Amendment in IPR2013-00111.
Dec. 18, 2013 Fig. 2 of EX1020 p. 13 marked up by witness Lacovara, Exhibit 2008 in IPR2013-00111.
Jan.-Mar. 2009 SATA News, Exhibit 2010 in IPR2013-00111.
SATA Dan-Am Air with Tony Larimer-YouTube, http://www.youtube.com/watch?v=iJtAGIAmSB0 obtained Oct. 9, 2013, Exhibit 2011 in IPR2013-00111.
Sata Spray Guns and Airbrush, http://www.myrideisme.com/Blog/sata-auto-paint-guns-sema/ obtained Oct. 9, 2013, Exhibit 2012 in IPR2013-00111.
How to Set Air Pressure Air Volume-YouTube, http://www.youtube.com/watch?v=HDuuJvyiZi1 obtained Oct. 9, 2013, Exhibit 2013 in IPR2013-00111.
Ohio EPA Letter to Tony Larimer submitted Nov. 11, 2013, Exhibit 2014 in IPR2013-00111.
Ben-Tzvi, Pinhas et al. "A Conceptual Design and FE Analysis of a Piezoceramic Actuated Dispensing System for Microdrops Generation in Microarray Applications". ScienceDirect (2007), Exhibit 2015 in IPR2013-00111.
Printout from Internet, http://www.amazon.com/Dispensing-Microdrops-Generation-Medical-A . . . obtained Oct. 14, 2013, Exhibit 2017 in IPR2013-00111.
Rone, William S. et al. "MEMS-Based Microdroplet Generation with Integrated Sensing". Excerpt from the Proceedings of the 2011 COMSOL Conference in Boston, Exhibit 2018 in IPR2013-00111.
Oct. 11, 2013 Larimer Deposition, Exhibit 2021 in IPR2013-00111.
Oct. 14, 2013 Schmon Deposition, Exhibit 2022 in IPR2013-00111.
Oct. 15, 2013 BenTzvi Deposition, Exhibit 2023 in IPR2013-00111.
Oct. 17, 2013 Akafuah Deposition, Exhibit 2024 in IPR2013-00111.
Certified translation of JP 8-196950 (Exhibit 1020 in IPR2013-00111).
Oct.-Dec. 1996 SATA News Publication Dan-Am, Exhibit 1035 in IPR2013-00111.
Dec. 9, 2013 Demonstrative 1, Substitute Claim 23, Exhibit 2025 from IPR2013-00111.
Dec. 9, 2013 Demonstrative 2, From pp. 44-46 of the transcript of the deposition of Nelson Akafuah, Exhibit 2026 in IPR2013-00111.
Jan. 11, 2013 Petition for Inter Partes Review in IPR2013-00111.
Apr. 10, 2013 Preliminary Response in IPR2013-00111.
May 23, 2013 Decision in IPR2013-00111.
Jun. 6, 2013 Petitioner's Request for Rehearing in IPR2013-00111.
Jun. 25, 2013 Decision on Rehearing in IPR2013-00111.
Jul. 25, 2013 Motion to Amend in IPR2013-00111.
Aug. 8, 2013 Motion to Amend (updated) in IPR2013-00111.
Sep. 30, 2013 Petitioner's Opposition in IPR2013-00111.
Oct. 21, 2013 Reply in IPR2013-00111.
Nov. 11, 2013 Motion to Exclude Evidence in IPR2013-00111.
Nov. 25, 2013 Petitioner's Opposition in IPR2013-00111.
Dec. 2, 2013 Reply to Petitioner's Opposition in IPR2013-00111.
Apr. 9, 2014 Oral Hearing Transcript in IPR2013-00111.
May 20, 2014 Final Written Decision in IPR2013-00111.
Jan. 24, 2013 First drawing based on Fig.2 of JP 8-196950, Exhibit 1003 in IPR2013-00111.
Jan. 24, 2013 Second drawing based on Fig. 2 of JP 8-196950, Exhibit 1004 in IPR2013-00111.
Jan. 24, 2013 Third drawing based on Fig 2 of JP 8-196950, Exhibit 1005 in IPR2013-00111.
Printout from Internet http://www.ehow.com/how_4493101_choose-spray-gun-auto-paint.html obtained Sep. 7, 2012, Exhibit 1023 in IPR2013-00111.
Printout from Internet http://www.bodyshopbusiness.com/Article/3512/common_sense_spraygun_tips.aspx obtained Sep. 7, 2012, Exhibit 1024 in IPR2013-00111.
Printout from Internet Brochure of Walther Pilot, www.walther-pilot.de published Mar. 2007, Exhibit 1025 in IPR2013-00111.
Printout from Internet http://www.alsacorp.com/products/hvlp-sprayguns/ obtained Aug. 26, 2012, Exhibit 1026 in IPR2013-00111.
Printout from Internet p. 28 from current 3M brochure, http://homesteadfinishingproducts.com/wp-content/uploads/2014/04/34-8701-7283-9-Automatic-Gun-Manual.pdf (2008), Exhibit 1027 in IPR2013-00111.
Sep. 5, 2012 Declaration of Knud Jorgensen, Exhibit 1028 in IPR2013-00111.
Apr. 12, 2012 decision by EPO, Exhibit 1029 in IPR2013-00111.
May 5, 2005 claims in issue in the Opp Proceeding of Exhibit 1029, Exhibit 1030 in IPR2013-00111.
Jan. 24, 2013 Prior art statement showing state-of-the-art in mid 1990s, Exhibit 1031 in IPR2013-00111.
Jul.-Sep. 1996 SATA News Publication Dan-Am, Exhibit 1034 in IPR2013-00111.
Apr.-Jun. 1998 SATA News Publication Dan-Am, Exhibit 1036 in IPR2013-00111.
1991 Dan-Am SATA Catalog 6 for spray guns, Exhibit 1037 in IPR2013-00111.
1994 Dan-Am SATA Catalog 8 for spray guns, Exhibit 1038 in IPR2013-00111.
1991 Dan-Am Catalog pp. 6-51, Exhibit 1042 in IPR2013-00111.
Mar. 1, 1991 JIS B 9809 English translation, Exhibit 1049 in IPR2013-00111.
Mar. 1, 1991 JIS B 9809, Exhibit 1050 in IPR2013-00111.
SATA LM 92 blueprints, SATA Gmbh (1984, 1986, 1990, 1992), Exhibit 1055 in IPR2013-00111.
SATAjet K, SATA Gmbh (1987, 1991, 1992), Exhibit 1056 in IPR2013-00111.

(56) References Cited

OTHER PUBLICATIONS

SATA NR 95, SATA Gmbh (1994, 1996), Exhibit 1057 in IPR2013-00111.
SATAjet 90, SATA Gmbh (1989, 1994, 1995, 1996, 1997), Exhibit 1058 in IPR2013-00111.
SATA GRZ, SATA Gmbh (1987, 1992), Exhibit 1059 in IPR2013-00111.
SATAjet B, SATA Gmbh (1980, 1987, 1991, 1992), Exhibit 1060 in IPR2013-00111.
SATAjet H, SATA Gmbh (1983, 1987, 1991), Exhibit 1061 in IPR2013-00111.
Enlarged view of table on p. 4 of SATAjet H (NPL 41), SATA Gmbh (1987), Exhibit 1062 in IPR2013-00111.
Jan. 1, 1995 SATA Gmbh Price list, Exhibit 1063 in IPR2013-00111.
Twist nozzle set with translation and certificate (1973, 1976), Exhibit 1064 in IPR2013-00111.
Sep. 18, 2013 Declaration of Nelson K Akafuah, Exhibit 1065 in IPR2013-00111.
Sep. 20, 2013 Declaration of Pinhas Ben-Tzvi, Exhibit 1066 in IPR2013-00111.
Sep. 23, 2013 Declaration of Anthony Larimer, Exhibit 1067 in IPR2013-00111.
Sep. 24, 2013 Declaration of Dr. Schmon signed, Exhibit 1068 in IPR2013-00111.
Sep. 13, 2013 Excerpted pages from EX2009 Lacovara Transcript, Exhibit 1069 in IPR2013-00111.
"How to Prepare Drawings for Patent Applications in Japan", http://www.jpo.go.jp/toiawase/faq/yokuar10.htm obtained Apr. 9, 2013, Exhibit 2001 in IPR2013-00111.
Sep. 13, 2013 Lacovara Deposition, Exhibit 2009 in IPR2013-00111.
Jan. 6, 2015 Office Action issued in Japanese Application No. 2012-173256.
Dec. 2, 2014 Office Action issued in Japanese Application No. 2012-177985.
Dec. 2, 2014 Office Action issued in Japanese Application No. 2012-192467.
Dec. 2, 2014 Office Action issued in Japanese Application No. 2012-176150.
Jan. 6, 2015 Office Action issued in Japanese Application No. 2012-192468.
Nov. 18, 2013 Search Report issued in European Application No. 13179078.4.
Oct. 31, 2013 Search Report issued in European Application No. 13179877.9.

* cited by examiner

SPRAY GUN

TECHNICAL FIELD

The present invention relates to a spray gun, in particular, a spray gun for mixing and atomizing a coating material flow and an air flow in the atmosphere.

BACKGROUND ART

For example, Japanese Unexamined Patent Application Publication No. 8-196950 (Patent Literature 1), or WO01/02099 (Patent Literature 2) disclose a spray gun, in which a gun barrel of the spray gun is provided with a coating material nozzle that ejects a coating material flow from a coating material ejection opening of a tip end portion thereof, and an air cap that surrounds the tip end portion of the coating material nozzle and defines in a gap with the tip end portion a ring shaped slit that ejects an air flow.

The tip end portion of the coating material nozzle has a guide wall on a tip end surface thereof spreading from an inner periphery of the coating material ejection opening toward a tip end side, and a plurality of V shaped grooves on an outer periphery thereof channeled from a predetermined position on a rear end side to the guide wall in a longitudinal direction. The guide wall is adapted to restrict the coating material flow ejected from the coating material ejection opening. The V shaped grooves are adapted to guide a part of the air flow toward a front side of the coating material ejection opening.

In the spray gun thus configured, when coating material is ejected from the coating material ejection opening to form the coating material flow, the air flow is introduced to the V shaped grooves through the slit from a body to collide and mix with the coating material flow ejected from the coating material ejection opening increasing air fluid contact area. As a result thereof, it is possible, even if a low pressure air flow is employed, to effectively atomize the ejected coating material up to a central portion thereof.

SUMMARY OF THE INVENTION

Technical Problem

The spray gun described above is configured to cause the air flow to be introduced to the V shaped grooves to collide and mix with the coating material flow from the coating material ejection opening so as to improve mixing efficiency of the air with the coating material and atomization of the coating material.

On the other hand, however, there is a drawback in which the air flow, when colliding and mixing with the coating material flow, becomes a resistance to the coating material flow and reduces ejection amount of the coating material.

The present invention has been made in view of above described circumstances, and an object thereof is to provide a spray gun that can improve mixing efficiency of the air with the coating material, while ensuring sufficient ejection amount of the coating material, and improve atomization of the coating material.

Solution to Problem

In order to attain the above described object, in accordance with a first aspect of the present invention, there is provided a spray gun for mixing and atomizing a coating material flow and an air flow in the atmosphere, the spray gun comprising:

a body having a gun barrel; a coating material nozzle disposed on a tip end side of the gun barrel, ejecting the coating material flow from a coating material ejection opening formed on a tip end surface thereof; and an air cap disposed on the tip end side of the gun barrel to surround a tip end portion of the coating material nozzle, the air cap defining a ring-shaped slit between an inner peripheral surface thereof and an outer peripheral surface of the tip end portion of the coating material nozzle to allow the air flow to be ejected there through, wherein the tip end portion of the coating material nozzle has on the tip end surface thereof a guide wall spreading from an inner periphery of the coating material ejection opening toward a tip end side of the coating material nozzle, the guide wall controlling the coating material flow ejected from the coating material ejection opening, and also has on the outer peripheral surface thereof a plurality of V-shaped grooves channeled in a longitudinal direction from a rear end side thereof in a predetermined position to the guide wall, the V-shaped grooves inducing a part of the air flow ahead of the coating material ejection opening, wherein the V-shaped groove has, in a triangle shaped cross section defined by contours crossing the guide wall, a height h in the range of 0.5 mm to 2.5 mm and an opening angle g of a bottom vertex in the range of 20 degrees to 100 degrees.

In accordance with a second aspect of the present invention, according to the first aspect of the spray gun, the V-shaped groove may have an area of the triangle shaped cross section defined by contours crossing the guide wall in the range of 0.25 $mm^2$ to 1.00 $mm^2$.

In accordance with a third aspect of the present invention, according to the first aspect of the spray gun, the V-shaped groove may have a length from the foremost of the tip end surface of the coating material nozzle to the rear end side thereof in the predetermined position along a central axis of the coating material nozzle in the range of 1.0 mm to 3.5 mm, and may also be formed with a bottom portion having a convergence angle directing toward the tip end side of the coating material nozzle in the range of 30 degrees to 100 degrees.

In accordance with a fourth aspect of the present invention, according to the first aspect of the spray gun, the coating material nozzle may be formed with four V-shaped grooves, the V-shaped grooves being arranged to form a crisscross shape around the coating material ejection opening on the tip end surface of the coating material nozzle.

In accordance with a fifth aspect of the present invention, according to the first aspect of the spray gun, the V-shaped grooves may be formed with bottom portions located on a circle larger in diameter than an inner periphery of the coating material ejection opening on the tip end part of the coating material nozzle.

In accordance with a sixth aspect of the present invention, according to the first aspect of the spray gun, the guide wall may be in a conical shape having an opening angle in the range of 60 degrees to 150 degrees in side view.

In accordance with a seventh aspect of the present invention, according to the first aspect of the spray gun, the V-shaped groove may be formed with a bottom portion located on the guide wall of the coating material nozzle between at 0.5 mm ahead and at 0.5 mm behind, in relation to a front surface proximate to the coating material nozzle of the air cap, in the longitudinal direction of the tip end portion of the coating material nozzle.

Advantageous Effects of Invention

According to the spray gun thus configured, it is possible to improve mixing efficiency of the air with the coating material to improve atomization of the coating material, while ensuring sufficient ejection amount of the coating material.

BRIEF DESCRIPTION OF DRAWINGS

FIG. 6 is a side view and a front view showing, together with the coating material nozzle, an auxiliary air hole formed on the air cap of the spray gun according to the first embodiment of the present invention.

FIG. 7 is a diagram illustrating a distribution of ejection amount of coating material in accordance with opening angle of a guide wall on a tip end surface of the spray gun according to the first embodiment of the present invention.

FIG. 8A is a front view of a tip end portion of a coating material nozzle, and FIG. 8B is a cross sectional view thereof.

DESCRIPTION OF EMBODIMENTS

Figure 1:
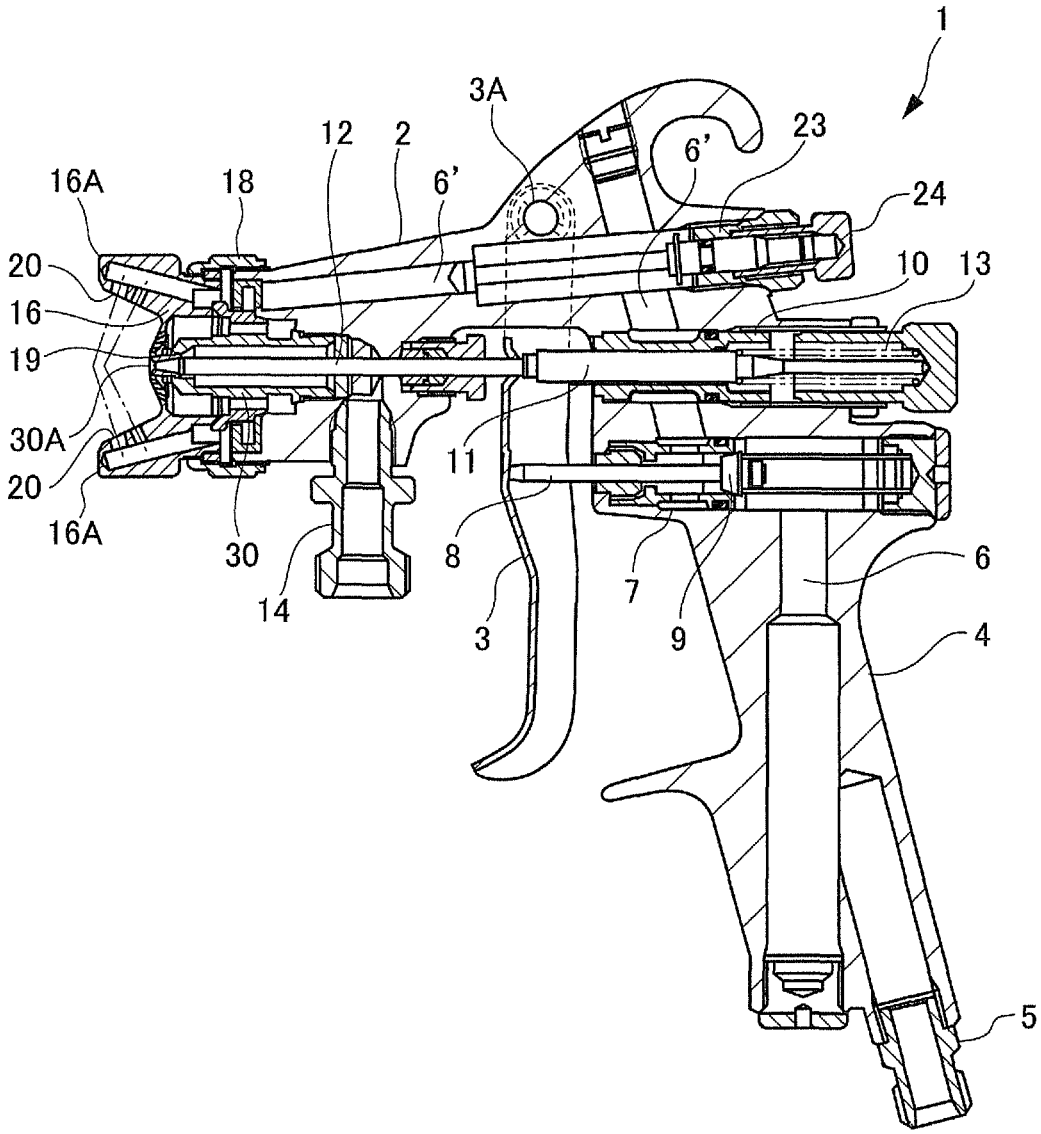
FIG. 1 is an overall configuration diagram of a spray gun according to a first embodiment of the present invention.

In the following, a detailed description will be given of embodiments of the present invention with reference to drawings. In all embodiments of the present specification, the same constituent elements have the same reference numerals.

First Embodiment

FIG. 1 is an overall configuration diagram of a spray gun 1 according to a first embodiment of the present invention.

In FIG. 1, the spray gun (body) 1 is configured to include a gun barrel (gun barrel) 2, a trigger 3, and a grip part 4. In the spray gun 1, a coating material flow and an air flow are ejected from a tip end portion of the gun barrel 2 in accordance with an operation of the trigger 3 so as to be mixed and atomized in the atmosphere.

In the description of constituent elements shown in FIG. 1, it should be noted that a side of the gun barrel 2 may be referred to as a "tip end" or a "front side", and an opposite side to the gun barrel 2 may be referred to as a "rear end" or a "rear side".

In FIG. 1, a compressed air is transmitted from the grip part 4 of the spray gun 1 to an air valve part 7 via an air nipple 5 and an air passage 6, and then to the tip end portion of the gun barrel 2 via an air passage 6'. The trigger 3 is adapted to be pulled toward a side of the grip part 4 centering on a fulcrum 3A, thereby to open an air valve 9 of the air valve part 7 via a valve stem 8 attached to the trigger 3 so that the compressed air is transmitted to the tip end portion of the gun barrel 2. To the trigger 3, there is fixed a needle valve guide 11 that recedes in a guide chamber 10 by pulling the trigger 3. To the needle valve guide 11, there is fixed a needle valve 12 disposed along a central axis of the gun barrel 2. When the trigger 3 is not pulled, a coil spring 13 disposed in the guide chamber 10 is adapted to press the needle valve 12 to an inner peripheral surface of a seat of a coating material ejection opening (coating material ejection opening) 30A of a coating material nozzle 30, which is mounted to a tip end side of the gun barrel 2, so that the seat of the coating material ejection opening 30A is sealed.

The air valve 9 is configured to be open, when the trigger 3 is pulled, slightly sooner than the needle valve 12 is pulled away from the coating material ejection opening 30A of the coating material nozzle 30.

The coating material nozzle 30 is configured by a cylindrical member whose tip end portion (hereinafter, referred to as a "nozzle tip end portion 31") is small in diameter and whose rear end portion is large in diameter. The rear end portion of the coating material nozzle 30 is formed with a coating material joint 14. Coating material is supplied to the coating material nozzle 30 from, for example, a coating material reservoir (not shown) or the like that is attached to the coating material joint 14. When the needle valve 12 of the coating material nozzle 30 is open, the coating material supplied to the coating material nozzle 30 is ejected as the coating material flow from the coating material ejection opening 30A of the coating material nozzle 30.

An air cap 16 is disposed so as to surround the nozzle tip end portion 31 of the coating material nozzle 30. The air cap 16 is attached to the gun barrel 2 by means of an air cap cover 18. A slit 19 in a ring shape is formed between an inner peripheral surface of the air cap 16 and an outer peripheral surface of the nozzle tip end portion 31 of the coating material nozzle 30. The compressed air from the air passage 6' causes an air flow to be ejected from the slit 19 along a periphery of the nozzle tip end portion 31 of the coating material nozzle 30 when the air valve 9 of air valve part 7 is opened.

Figure 2:
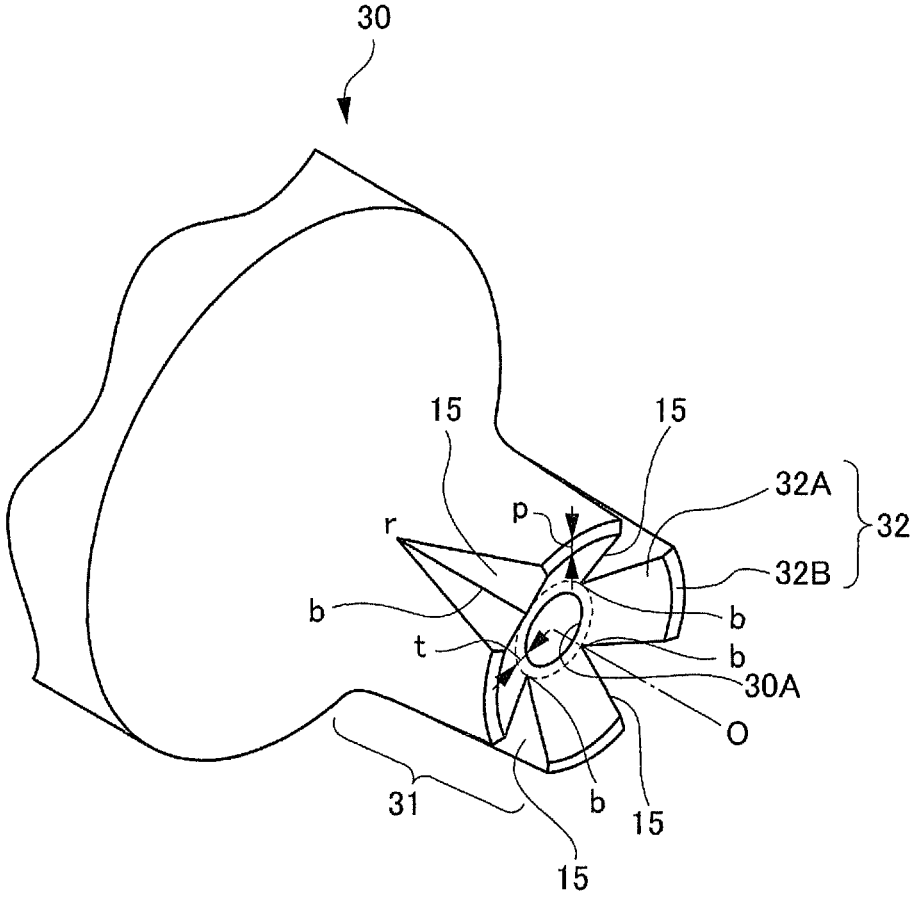
FIG. 2 is a perspective view showing a tip end portion of a coating material nozzle of the spray gun according to the first embodiment of the present invention.

As shown in FIG. 2, the nozzle tip end portion 31 of the coating material nozzle 30 includes a tip end surface 32. The coating material ejection opening 30A is formed on a central axis of the tip end surface 32. An inner diameter of the coating material ejection opening 30A is formed relatively small compared to an outer diameter of the nozzle tip end portion 31 of the coating material nozzle 30. The tip end surface 32 of the coating material nozzle 30 includes a guide wall 32A that restricts the coating material flow ejected from the coating material ejection opening 30A. The guide wall 32A is formed in a conical shape spreading from an inner periphery of the coating material ejection opening 30A toward a tip end side of the coating material nozzle 30. An outer peripheral edge of the guide wall 32A is located at a distance of less than 0.5 mm inwardly from an outer periphery of the nozzle tip end portion 31 of the coating material nozzle 30, viewed from the front. This means that the outer peripheral edge of the guide wall 32A is formed to be at a distance p of less than 0.5 mm inwardly from the outer periphery of the nozzle tip end portion 31 of the coating material nozzle 30. More specifically, the tip end surface 32 of the coating material nozzle 30 is formed with, in addition to the guide wall 32A, a flat portion 32B in shape of a ring having a width of 0.5 mm or less, which is a surface perpendicular to a central axis O of the coating material nozzle 30 from the outer peripheral edge of the guide wall 32A to the outer peripheral edge of the nozzle tip end portion 31 of the coating material nozzle 30. According to such a configuration, in which the outer peripheral edge of the guide wall 32A is designed to be at a distance of less than 0.5 mm inwardly from the outer periphery of the nozzle tip end portion 31 of the coating material nozzle 30, it is possible to acquire effects of increasing the ejection amount of the coating material from the coating material ejection opening 30A and improving atomization, which will be described later in detail.

Figure 3:
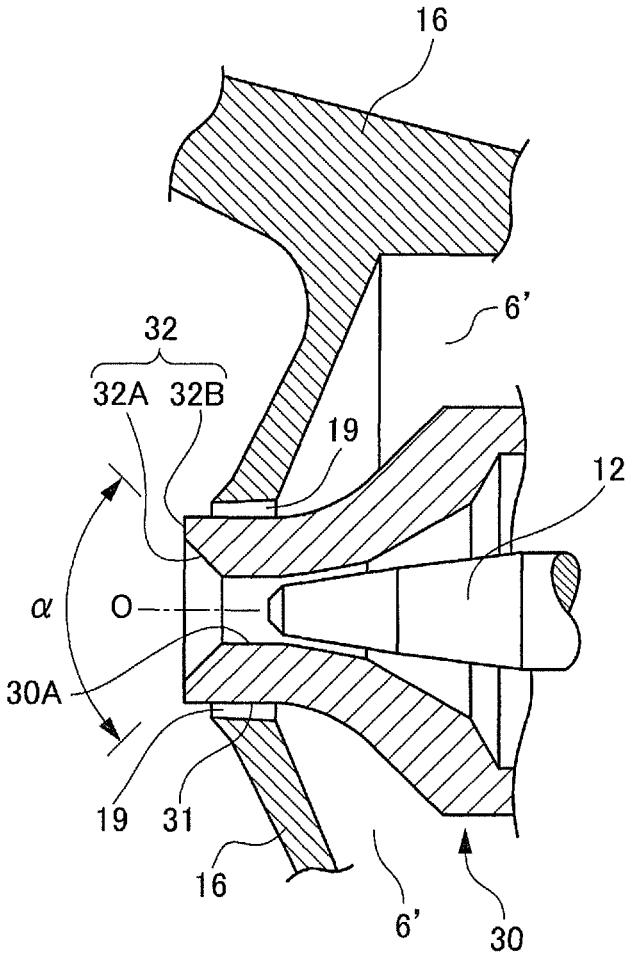
FIG. 3 is a cross sectional view (along a plane not including a V shaped groove) showing, together with an air cap, the tip end portion of the coating material nozzle of the spray gun according to the first embodiment of the present invention.

As shown in FIG. 3, which is an enlarged cross sectional view of the nozzle tip end portion 31 of the coating material nozzle 30, the guide wall 32A in a conical shape is configured to have an opening angle $\alpha$ between 60 and 150 degrees in side view. According to the above described configuration to have the opening angle $\alpha$ of the guide wall 32A between 60 and 150 degrees, it is possible to reduce a surface angular change to the guide wall 32A from a straight passage of the coating material ejection opening 30A of the coating material nozzle 30 and to smooth the coating material flow along the guide wall 32A, as will be described later in detail. Incidentally, as well as the coating material nozzle 30, the needle valve 12 and the air cap 16 are also shown in FIG. 3.

Figure 4:
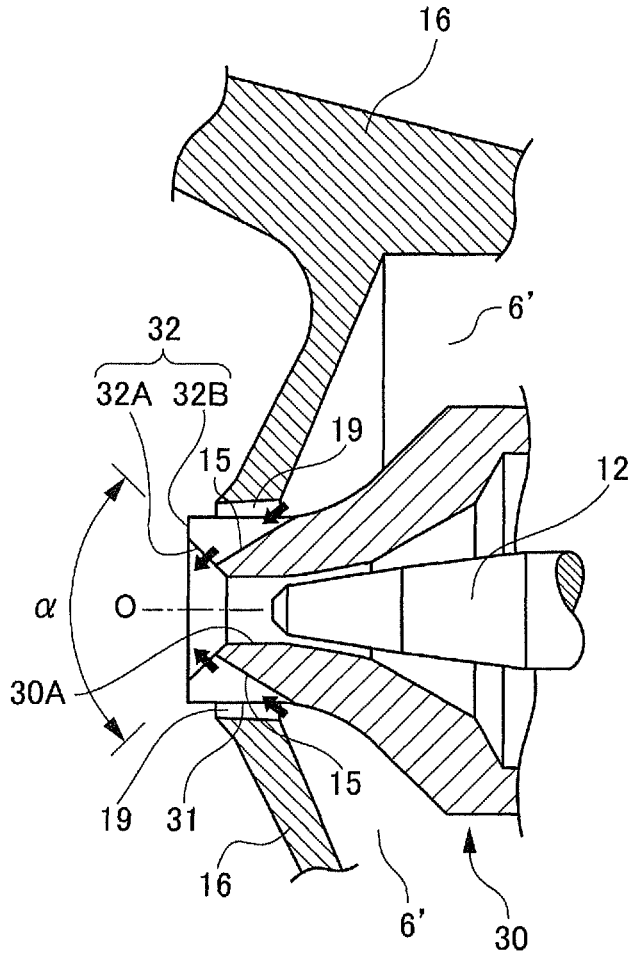
FIG. 4 is a cross sectional view (along a plane including the V shaped groove) showing, together with the air cap, the tip end portion of the coating material nozzle of the spray gun according to the first embodiment of the present invention.

Referring back to FIG. 2, the nozzle tip end portion 31 of the coating material nozzle 30 is formed with, for example, four V shaped grooves 15 at equal spaces in a circumferential direction on the outer peripheral surface thereof. This means that the V shaped grooves 15 are disposed to form a crisscross shape centering on the coating material ejection opening 30A viewing from a front end side of the coating material nozzle 30. Each V shaped groove 15 is channeled from a predetermined position (which may be hereinafter referred to as a "starting point r of the V shaped groove 15") on a rear end side (left side in FIG. 2) up to the tip end surface 32. Each V shaped groove 15 includes a bottom portion, which increases in depth toward the tip end surface 32 of the coating material nozzle 30. The V shaped grooves 15 are configured to guide a part of the air flow ejected through the slit 19 from the air passage 6' toward a front side of the coating material ejection opening 30A. In FIG. 4, which is different from FIG. 3 in that FIG. 4 has a cross section of a part where the V shaped groove 15 is formed, the compressed air from the air passage 6', when being ejected through the slit 19, is guided in the V shaped grooves 15 of the coating material nozzle 30 as shown by arrows in FIG. 4. The air flow in the V shaped grooves 15 collides and mixes with the coating material flow from the coating material ejection opening 30A of the coating material nozzle 30 increasing gas-liquid contact area. As a result thereof, it is possible for the compressed air, even if being a low pressure air flow, to function to atomize up to a central portion of the ejected coating material.

As shown in FIG. 2, each V shaped groove 15 is configured to have the bottom portion (denoted by b in FIG. 2) positioned within a range of the guide wall 32A on the tip end surface 32 of the coating material nozzle 30. More particularly, the bottom portion b of each V shaped groove 15 is formed, on the tip end surface 32 of the coating material nozzle 30, on a circle larger in radius by, for example, t (>0) than the inner periphery of the coating material ejection opening 30A. This means that it is configured so as to exclude a case in which the bottom portion b of each V shaped groove 15 is positioned on the inner periphery of the coating material ejection opening 30A or even penetrates to an inner peripheral surface thereof. According to such configuration that the bottom portion b of each V shaped groove 15 is positioned within the range of the guide wall 32A on the tip end surface of the coating material nozzle 30, it is possible to greatly reduce a resistance against the coating material flow generated by the compressed air flowing in the V shaped grooves 15 and penetrating in the coating material flow ejected from the coating material ejection opening 30A of the coating material nozzle 30.

Figure 5:
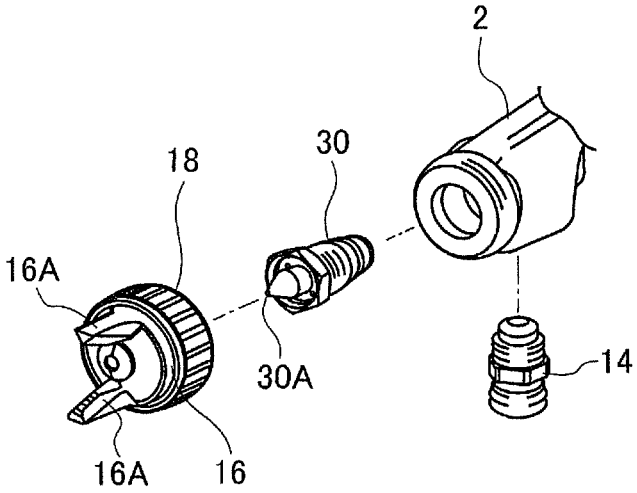
FIG. 5 is an exploded perspective view showing the coating material nozzle, the air cap, and a coating material joint that are mounted to a gun barrel of the spray gun according to the first embodiment of the present invention.

Referring back to FIG. 1, the air cap 16 is formed on a tip end surface thereof with a pair of horn portions 16A having the coating material nozzle 30 in between. FIG. 5 is a perspective view showing the air cap 16 together with a part of the gun barrel 2 in vicinity, which shows that the pair of horn portions 16A are formed so as to face toward each other and have the coating material ejection opening 30A of the coating material nozzle 30 in between. As shown in FIG. 1, each horn portion 16A of the air cap 16 has a side air hole 20 in communication with the air passage 6'. The side air holes 20 are adapted to eject the air flow so as to intersect with the coating material flow from the coating material ejection opening 30A of the coating material nozzle 30. As a result thereof, the coating material ejected from the coating material nozzle 30 can form an elliptical spray pattern by the aid of the compressed air ejected from the side air holes 20 of the air cap 16. The compressed air transmitted to the side air holes 20 of the air cap 16 is adjusted in flow rate by means of a spread pattern adjustment device 23 and then ejected from the side air holes 20. In the spread pattern adjustment device 23, a pattern adjustment tab 24 is adapted to be rotated so that the compressed air is adjusted in flow rate. As a result thereof, the spray pattern of the coating material ejected from the coating material nozzle 30 is adjusted in spread angle in a fan shape.

Figure 6B:
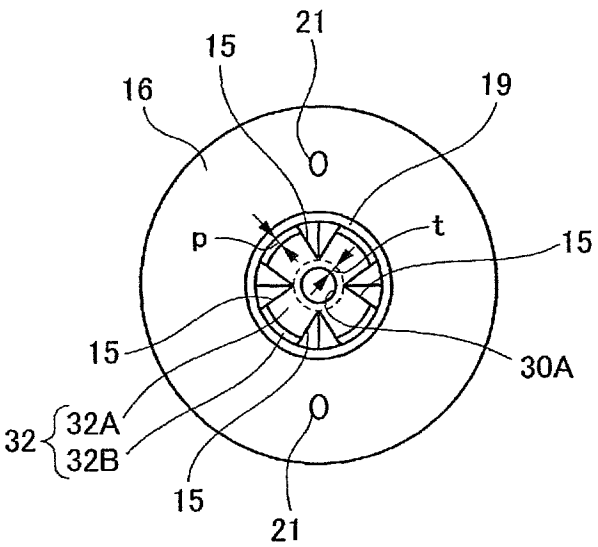
FIG. 6B is a front view of the same.
Figure 6A:
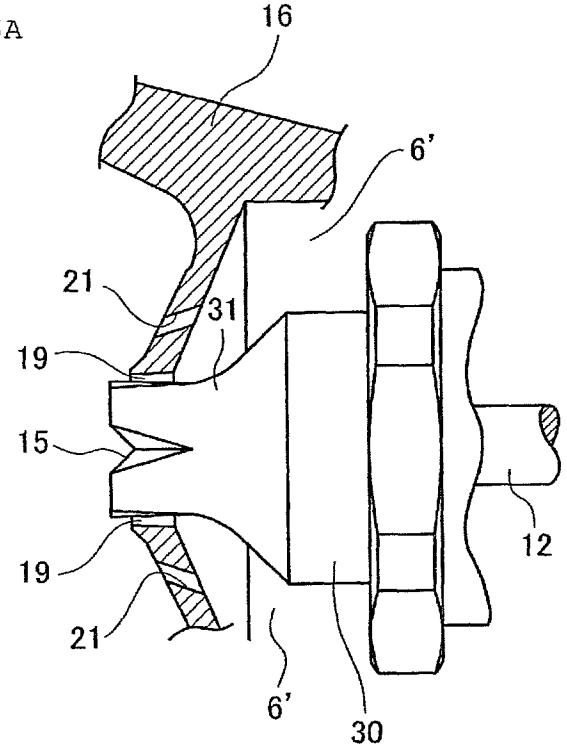
FIG. 6A is a side view of the air cap (shown in cross section) with the coating material nozzle together.

As shown in FIGS. 6A and 6B, though omitted in FIGS. 1, 3, and 4, the air cap 16 is formed in the vicinity of the nozzle tip end portion 31 of the coating material nozzle 30 with a pair of auxiliary air holes 21 having the nozzle tip end portion 31 of the coating material nozzle 30 in between. FIG. 6A is a side view of the air cap 16 (shown in cross section) with the coating material nozzle 30 together, and FIG. 6B is a front view of the same. The auxiliary air holes 21 are formed in communication with the air passage 6', and the air flow from the auxiliary air holes 21 intersects with the coating material flow from the coating material ejection opening 30A of the coating material nozzle 30. The auxiliary air holes 21 are adapted to take a balance with a force of the air flow ejected from the side air holes 20 for the purpose of spray pattern formation.

According to the spray gun 1 configured as described above, it is possible to have the following effects.

(1) In the spray gun 1, each V shaped groove 15 of the coating material nozzle 30 is configured to have the bottom portion b thereof within the range of the guide wall 32A at an open end thereof. As a result thereof, it is possible to avoid the air flow in the V shaped groove 15 from directly flowing in the coating material flow ejected from the coating material ejection opening 30A. Accordingly, it is possible to greatly reduce the resistance against the coating material flow generated by the air flow in the V shaped grooves 15 penetrating in the coating material flow ejected from the coating material ejection opening 30A. Thus, it is possible to increase amount of the coating material flow ejected from the coating material ejection opening 30A of the coating material nozzle 30, and to increase the amount of the coating material flow in accordance with enlargement of the coating material ejection opening 30A in inner diameter.

(2) The spray gun 1 is configured so that the outer peripheral edge of the guide wall 32A is formed within the radial distance p of 0.5 mm or less from the outer peripheral edge of the nozzle tip end portion 31 of the coating material nozzle 30. As a result thereof, it is possible to have an effect of increase in ejection amount of the coating material flow and improvement in atomization. It has been observed that, if the outer peripheral edge of the guide wall 32A is formed at the radial distance p of more than 0.5 mm from the outer peripheral edge of the nozzle tip end portion 31 of the coating material nozzle 30, a turbulent flow emerges on the tip end surface 32 of the coating material nozzle 30 due to the air flow in the V shaped grooves 15 and another air flow on the outer peripheral surface of the nozzle tip end portion 31 of the coating material nozzle 30. On the other hand, if the radial distance p between the outer peripheral edge of the guide wall 32A and the outer peripheral edge of the nozzle tip end portion 31 of the coating material nozzle 30 is reduced to be within the aforementioned range of 0.5 mm or less, the turbulent flow will be diminished. As a result thereof, since the air flow along the guide wall 32A becomes smooth, it becomes possible to increase the ejection amount of the coating material and to improve the atomization of the coating material.

Figure 7A:
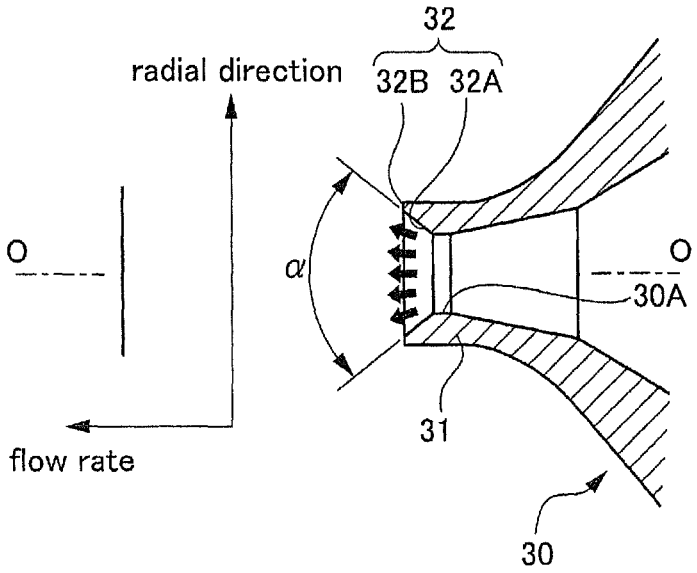
FIG. 7A shows a case in which the guide wall is formed to have an opening angle $\alpha$ between 60 and 150 degrees.

(3) In the spray gun 1, the guide wall 32A on the tip end surface 32 of the coating material nozzle 30 is configured to have the opening angle $\alpha$ between 60 and 150 degrees. As a result thereof, since the surface angular change to the guide wall 32A from the straight passage of the coating material ejection opening 30A of the coating material nozzle 30 can be reduced, the coating material flow along the guide wall 32A becomes as shown by arrows in the right part of FIG. 7A, thereby a smooth flow can be formed. As shown in the left part of FIG. 7A, the coating material flow toward the guide wall 32A becomes uniform, and the coating material is ejected in a flat shape from the coating material ejection opening 30A. As a result thereof, it is possible to have an effect of increasing the ejection amount of the coating material. Here, in the left part of FIG. 7A, the vertical axis corresponds to a radial direction of the tip end surface 32 of the coating material nozzle 30, and the horizontal axis corresponds to a flow rate of the coating material.

Figure 7B:
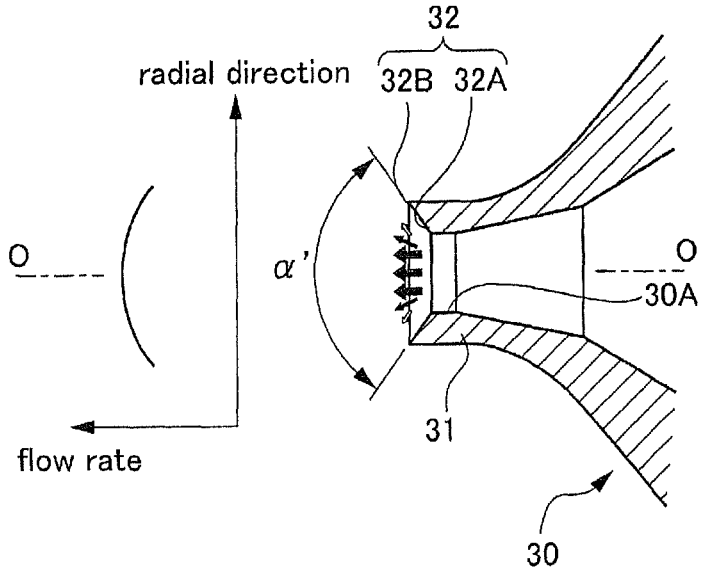
FIG. 7B shows a case in which the guide wall is formed to have an opening angle $\alpha'$ larger than 150 degrees.

On the other hand, FIG. 7B shows a distribution of ejection amount of the coating material from the coating material ejection opening 30A in a case in which the guide wall 32A is formed to have an opening angle $\alpha'$ larger than 150 degrees. As shown in the right part of FIG. 7B, the coating material ejected from the coating material ejection opening 30A does not flow well along the guide wall 32A. Therefore, as shown in the left part of FIG. 7B, the coating material flow is "center thick", i.e., dense in the vicinity of a central axis of the coating material ejection opening 30A but becomes sparser toward off the central axis, thereby the uniformity of the coating material flow is broken.

(4) Thus, according to the spray gun 1, it is possible to prevent hindrance to increase in ejection amount of the coating material from the air flow that penetrates in the coating material ejected from the coating material ejection opening 30A through the plurality of V shaped grooves 15 formed on the outer peripheral surface of the nozzle tip end portion 31 of the coating material nozzle 30. As a result thereof, it becomes possible to attain improvement in atomization and flattening of the coating material flow.

Second Embodiment

Figure 8:
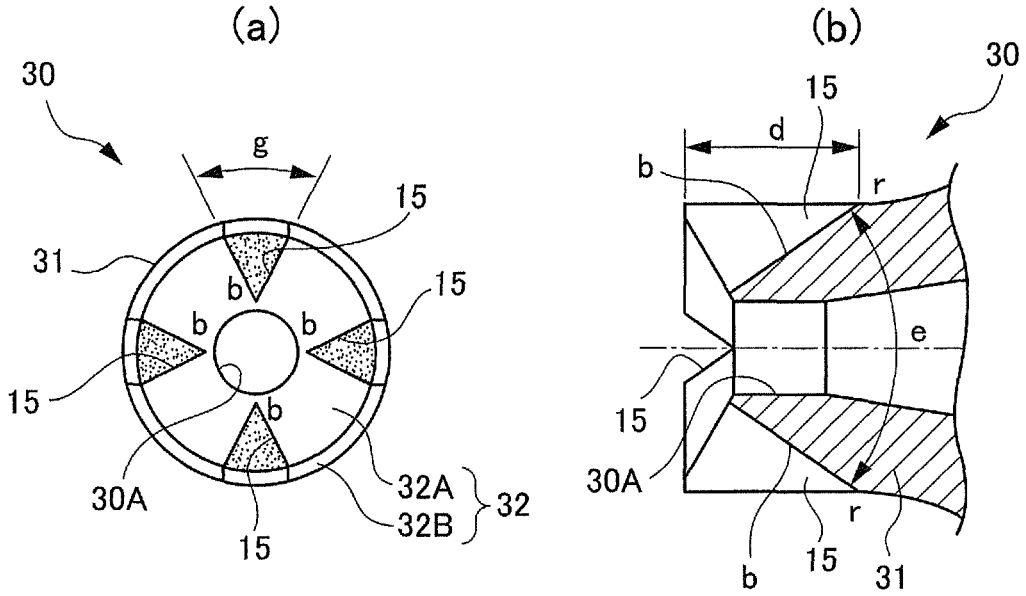
FIG. 8 is a configuration diagram showing a principal part of a spray gun according to a second embodiment of the present invention.

FIGS. 8A and 8A are configuration diagrams showing a principal part of a spray gun 1 according to a second embodiment of the present invention. FIG. 8A is a front view of a nozzle tip end portion 31 of a coating material nozzle 30, and FIG. 8B is a cross sectional view thereof.

Similarly as described in the first embodiment, the nozzle tip end portion 31 of the coating material nozzle 30 shown in FIGS. 8A and 8B includes on a tip end surface 32 a guide wall 32A spreading from an inner periphery of the coating material ejection opening 30A toward a tip end side of the coating material nozzle 30, and includes on an outer peripheral surface thereof a plurality of V shaped grooves 15 channeled from a predetermined position on a rear end side thereof to the guide wall 32A in a longitudinal direction of the coating material nozzle 30. Each V shaped groove 15 is configured to have a bottom portion b that gradually becomes deeper toward the tip end side and opens to the tip end surface 32 of the coating material nozzle 30 within a range of the guide wall 32A.

In addition to the above described configuration, in the present embodiment, an area of triangle shaped cross section (shown by dots in FIG. 8A: hereinafter, may be referred to as a "passage area") partitioned by an intersection contour of the V shaped groove 15 with the guide wall 32A is determined by an imaginary height (denoted by h in FIG. 8A) along the guide wall 32A and an opening angle (denoted by g in FIG. 8A) of a bottom vertex. The height h is set between 0.5 mm and 2.5 mm, and the opening angle g is set between 20 and 100 degrees.

The above described configuration is based on the following reason. The air flow in the V shaped groove 15, when entering the coating material flow, becomes resistance thereto and reduces ejection amount of the coating material. If the resistance to the coating material increases, the reduction in ejection amount of the coating material will increase. If the resistance to the coating material decreases, the reduction in ejection amount of the coating material will decrease. Basically, the ejection amount of the coating material tends to decrease due to the presence of the V shaped grooves 15.

On the other hand, the air flow in the V shaped grooves 15 mixes with the coating material flow, which enhances mixing efficiency of the air with the coating material and atomization of the coating material. If the mixing efficiency increases, improvement in atomization will increase. If the mixing efficiency decreases, improvement in atomization will decrease. Basically, atomization tends to increase due to the presence of the V shaped grooves 15.

Accordingly, it is possible to adjust the resistance to the coating material flow and the mixing efficiency of the compressed air with the coating material by adjusting the passage area of the V shaped grooves 15 intersecting with the guide wall 32A. If the resistance to the coating material flow increases, the mixing efficiency of the compressed air with the coating material will increase.

In the following, a detailed description will be given of a practical range of h, g, d, and e in actual use (d and e will be defined later).

Figure 9A:
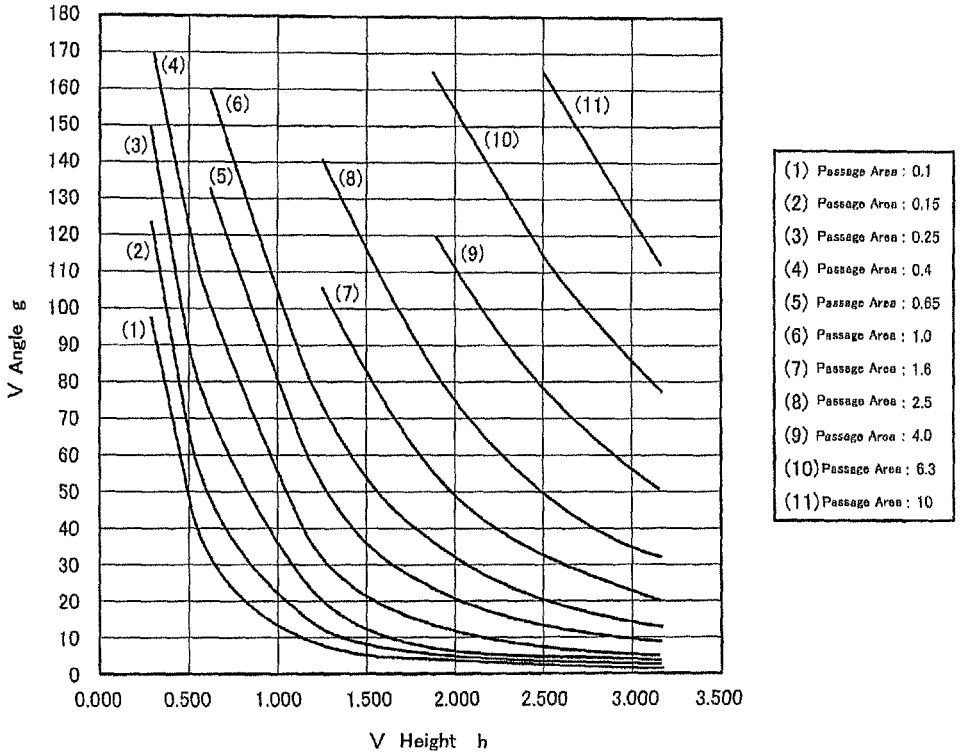
FIG. 9A is a graph illustrating a relationship among a height h of a triangle shaped cross section partitioned by an intersection contour of a V shaped groove with a guide wall, an opening angle g of a bottom vertex of the triangle shaped cross section partitioned by the intersection contour of the V shaped groove with the guide wall, and a passage area of the spray gun according to the present invention.
Figure 9B:
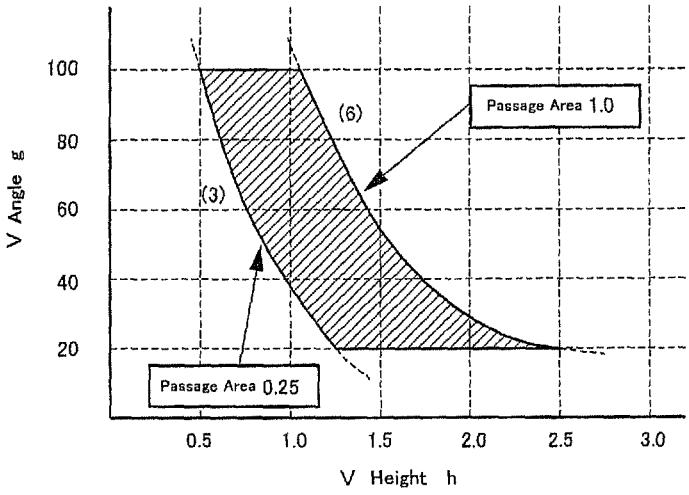
FIG. 9B shows a region of FIG. 9A surrounded by curves (3) and (6) with h between 0.5 mm and 2.5 mm and g between 20 and 100 degrees.

FIG. 9A is a graph illustrating a relationship among h (the height of the triangle shaped cross section partitioned by the intersection contour of the V shaped groove 15 with the guide wall 32A), g (the opening angle of the bottom vertex of the triangle shaped cross section partitioned by the intersection contour of the V shaped groove 15 with the guide wall 32A), and the passage area. In the graphs of FIGS. 9A and 9B, h is denoted by the horizontal axis, g is denoted by the vertical axis, and the passage area is denoted by curves (1) to (11). In FIG. 9A, the passage area is 0.1 $mm^2$ on curve (1), 0.15 $mm^2$ on curve (2), 0.25 $mm^2$ on curve (3), 0.4 $mm^2$ on curve (4), 0.65 $mm^2$ on curve (5), 1.0 $mm^2$ on curve (6), 1.6 $mm^2$ on curve (7), 2.5 $mm^2$ on curve (8), 4.0 $mm^2$ on curve (9), 6.3 $mm^2$ on curve (10), and 10 $mm^2$ on curve (11).

Here, as shown in FIG. 9B, it is experimentally proved that a practically sufficient performance can be obtained in the region surrounded by curves (3) and (6) with h between 0.5 mm and 2.5 mm and g between 20 and 100 degrees.

In addition to the above configuration, it is configured so that a length d (hereinafter, simply referred to as a "length d of the V shaped groove 15") from a foremost tip end surface of the coating material nozzle 30 to a starting point r of the V shaped groove 15 falls within a range between 1.0 mm and 3.5 mm along a central axis of the coating material nozzle 30, and a convergence angle e (hereinafter, simply referred to as a "convergence angle e of the V shaped grooves 15") formed toward the tip end side of the coating material nozzle 30 by the bottom portions b of a pair of V shaped grooves facing toward each other falls within a range between 30 and 100 degrees.

Figure 10A:
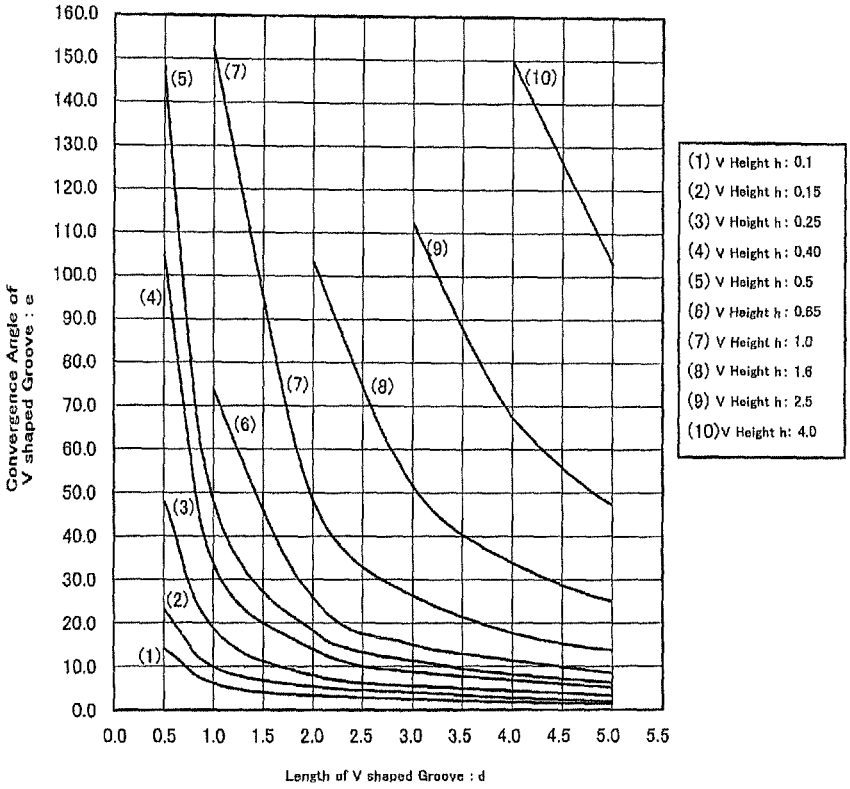
FIG. 10A is a graph illustrating a relationship among a length of the V shaped groove, a convergence angle of the V shaped groove, and the height of the triangle shape of passage area of the spray gun according to the present invention.
Figure 10B:
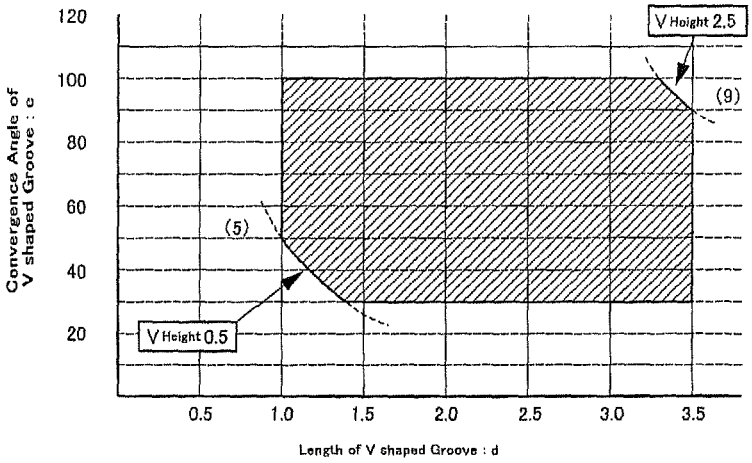
FIG. 10B shows an area defined by e being in the range between 30 and 100 degrees and d being in the range between 1.0 mm and 3.5 mm roughly falls between curves (5) and (9).

FIG. 10A is a graph illustrating a relationship among the length d of the V shaped groove 15, the convergence angle e of the V shaped groove 15, and the height h of the triangle shaped cross section of the passage area. In the graphs of FIGS. 10A and 10B, d is denoted by the horizontal axis, e is denoted by the vertical axis, and the height h of the triangle shape of the passage area is denoted by curves (1) to (10). In FIG. 10A, the height is 0.1 mm on curve (1), 0.15 mm on curve (2), 0.25 mm on curve (3), 0.4 mm on curve (4), 0.5 mm on curve (5), 0.65 mm on curve (6), 1.0 mm on curve (7), 1.6 min on curve (8), 2.5 mm on curve (9), and 4.0 mm on curve (10).

In this case, as shown in FIG. 10B, it is evident that the area defined by e being in the range between 30 and 100 degrees and d being in the range between 1.0 mm and 3.5 mm roughly falls between curves (5) and (9). Accordingly, if e is set between 30 and 100 degrees and d is set between 1.0 mm and 3.5 mm, the height h can be made roughly in the range from 0.5 mm to 2.5 mm.

If the length d of the V shaped groove 15 is less than 1.0 mm, the passage area of the V shaped groove 15 will be too small to have the effect of the V shaped groove 15, and if more than 3.5 mm, the V shaped groove 15 will be open to inside of the coating material ejection opening 30A. If the opening angle g of the V shaped groove 15 is less than 20 degrees, the passage area of the V shaped groove 15 will be too small to have the effect of the V shaped groove 15, and if more than 100 degrees, the passage area of the V shaped groove 15 will be too large to let out the coating material. If the convergence angle e of the V shaped groove 15 is less than 30 degrees, the passage area of the V shaped groove 15 will be too small to have the effect of the V shaped groove 15, and if more than 100 degrees, the V shaped groove 15 will be open to inside of the coating material ejection opening 30A.

As described above, according to the spray gun 1 shown in the second embodiment, it becomes possible to ensure a sufficient ejection amount of the coating material, while improving atomization of the coating material.

It is needless to mention that the configuration shown in the second embodiment can be employed in combination with any one of the above described first embodiment and the third to fifth embodiments, which will be described later.

As above, in the second embodiment, a predetermined condition is set on a triangle shaped cross section partitioned by an intersection contour of a V shaped groove with a guide wall on a tip end surface of a coating material nozzle.

In this case, it has been observed to be possible to improve mixing efficiency of air with coating material, ensure sufficient ejection amount of the coating material, and improve atomization of the coating material by setting a range of conditions on a length of the V shaped groove from a foremost tip end surface of the coating material nozzle to a predetermined position on a rear end side, and a convergence angle toward a tip end side of the coating material nozzle of a pair of V shaped grooves facing toward each other

Third Embodiment

Figure 11:
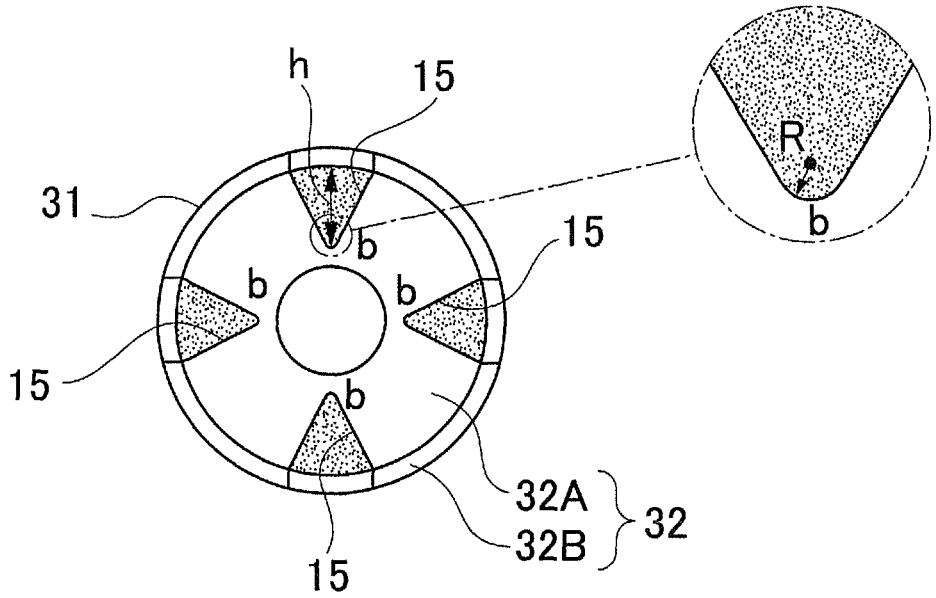
FIG. 11 is a front view of a tip end portion of a coating material nozzle showing a configuration of a principal part of a spray gun according to a third embodiment of the present invention.

FIG. 11 is a configuration diagram of a principal part of a spray gun 1 according to a third embodiment of the present invention. FIG. 11, corresponding to FIG. 8A, is a front view of a nozzle tip end portion 31 of a coating material nozzle 30.

Similarly as described in the first embodiment, the coating material nozzle 30 includes on a tip end surface 32 of the nozzle tip end portion 31 a guide wall 32A spreading from an inner periphery of a coating material ejection opening 30A toward a tip end side of the coating material nozzle 30, and includes on an outer peripheral surface thereof a plurality of V shaped grooves 15 channeled from a predetermined position on a rear end side thereof to the guide wall 32A in a longitudinal direction of the coating material nozzle 30. Each V shaped groove 15 is configured to have a bottom portion b that becomes deeper toward the tip end side and opens to the tip end surface 32 of the coating material nozzle 30 within a range of the guide wall 32A.

In addition to the above described configuration, in the present embodiment, the bottom portion b of each V shaped groove 15 is configured to have a curvature radius R of 0.15 mm or less.

The above described configuration is based on the following reason. The V shaped groove 15 of the nozzle tip end portion 31 of the coating material nozzle 30 is formed by, for example, a cutting tool, which has a nose R (nose radius) on a tip thereof. As a result thereof, the bottom portion b of the V shaped groove 15 is also formed with the curvature radius R. Here, a passage area (shown by dots in FIG. 11) of the V shaped groove 15 depends on the curvature radius R of the bottom portion b of the V shaped groove 15. As the curvature radius R is smaller, a height h of a triangle shape of the passage area becomes larger, the collision time of a coating material flow and an air flow becomes longer, and the mixing efficiency of the air flow with the coating material flow is more improved. Furthermore, in this case, mixture of the air flow to the coating material flow proceeds more gradually, and dispersion of the coating material flow proceeds more gradually as well, thus the coating material flow from the coating material nozzle 30 becomes less adhering to an air cap 16 disposed in proximity to the coating material nozzle 30.

Therefore, according to the spray gun 1 shown in the third embodiment, it becomes possible to improve the mixing efficiency of the air flow with the coating material flow and to avoid the adherence to the air cap 16 of the coating material from the coating material nozzle 30.

It is needless to mention that the configuration shown in the third embodiment can be employed in combination with any one of the above described first and second embodiments and the fourth and fifth embodiments, which will be described later.

Fourth Embodiment

Figure 12:
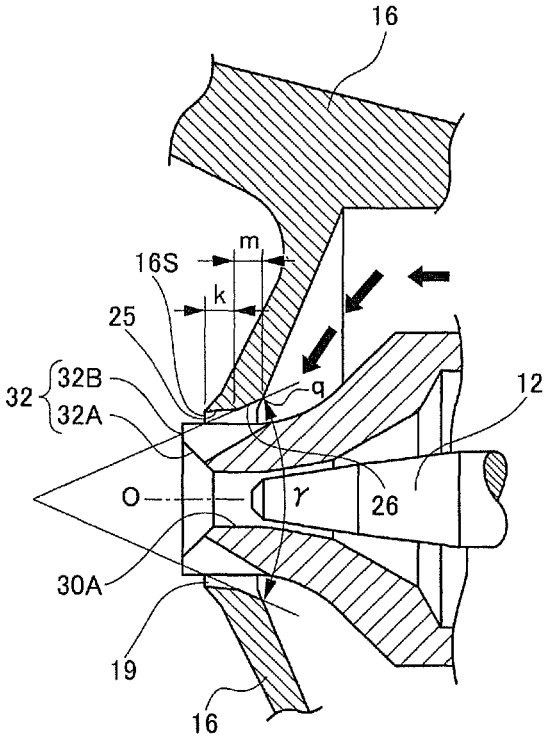
FIG. 12 is a cross sectional view of a tip end portion of a coating material nozzle and an air cap disposed surrounding the tip end portion showing a configuration of a principal part of a spray gun according to a fourth embodiment of the present invention.

FIG. 12 is a configuration diagram showing a principal part of a spray gun (body) 1 according to a fourth embodiment. FIG. 12 is a cross sectional view of a nozzle tip end portion 31 of a coating material nozzle 30 and an air cap 16 disposed surrounding the nozzle tip end portion 31.

Similarly as described in the first embodiment, the coating material nozzle 30 includes on a tip end surface 32 of the nozzle tip end portion 31 a guide wall 32A spreading from an inner periphery of a coating material ejection opening 30A toward a tip end side of the coating material nozzle 30, and includes on an outer peripheral surface thereof a plurality of V shaped grooves 15 channeled from a predetermined position on a rear end side thereof to the guide wall 32A in a longitudinal direction of the coating material nozzle 30. Each V shaped groove 15 is configured to have a bottom portion b that becomes deeper toward the tip end side and opens to the tip end surface 32 of the coating material nozzle 30 within a range of the guide wall 32A.

In addition to the above described configuration, in the present embodiment, the air cap 16 includes on an inner peripheral surface thereof a parallel surface 25 that parallels and faces an outer peripheral surface of the nozzle tip end portion 31 of the coating material nozzle 30, and a tapered surface 26 that spreads in conical shape from a rear end of the parallel surface 25. The parallel surface 25 has, in side view, a width k between 0.3 mm and 1.0 mm along a central axis of the air cap 16. The tapered surface 26 has, in side view, a width m between 0.1 mm and 0.5 mm along the central axis of the air cap 16 and an opening angle γ between 10 and 90 degrees toward the rear end side of the coating material nozzle 30.

The above described configuration is based on the following reason. If an air flow entering the V shaped grooves 15 is sufficiently strong, the air flow in the V shaped grooves 15 will be smooth, and efficiency will be enhanced of collision and mixture of the air flow with a coating material flow. As a result thereof, the coating material flow will be well dispersed and form a flat spray pattern in which amount of atomized coating material flow is approximately uniform in a radial direction of the tip end surface of the coating material nozzle 30.

The air flow entering the V shaped grooves 15 becomes stronger as a starting point r of the V shaped groove 15 is positioned more on a side of the body than a rear end q of a slit 19 in a ring shape formed between the air cap 16 and the nozzle tip end portion 31 of the coating material nozzle 30, and distance in longitudinal direction of the nozzle tip end portion 31 from the starting point r of the V shaped groove 15 to the rear end q of the slit 19 is longer. This is because the air flow coming in the air cap 16 directly heads toward the V shaped grooves 15, thereby the air flow in the V shaped grooves 15 becomes strong.

On the other hand, if the starting point r of the V shaped groove 15 is set more forward than the rear end q of the slit 19, the air flow will not directly enter the V shaped grooves 15. Therefore, the air flow in the V shaped grooves 15 will be weak, and efficiency of mixture with the coating material will decrease.

As described above, the inner peripheral surface of the air cap 16 is formed with the parallel surface 25 facing parallel to the outer peripheral surface of the nozzle tip end portion 31 of the coating material nozzle 30, as well as the tapered surface 26 spreading in conical shape from the rear end of the parallel surface 25. The parallel surface 25 is adapted to maintain the straight air flow in a gap with the coating material nozzle 30, thereby ensure ejection amount of the coating material. The tapered surface 26 is adapted to smooth the air flow to the parallel surface 25 and to adjust the strength of the air flow entering the V shaped grooves 15 by adjusting the width m of the tapered surface 26.

If the width k of the parallel surface 25 along the central axis of the air cap 16 is less than 0.3 mm, the air flow cannot be maintained straight, and the ejection amount of the coating material will decrease. On the other hand, if the width k of the parallel surface 25 along the central axis of the air cap 16 exceeds 1.0 mm, the parallel surface 25 of the air cap 16 will be close to the starting point r, and a passage area of the air flow will be narrow. Therefore, amount of the air flow in the V shaped grooves 15 is restricted, which causes decrease in atomization and ejection amount of the coating material. Therefore, the width k of the parallel surface 25 along the central axis of the air cap 16 is preferably set in the range of 0.3 mm to 1.0 mm.

With regard to the tapered surface 26, if the width m is less than 0.1 mm, the air flow entering the V shaped grooves 15 will be excessively strong, and the coating material flow will form the flat spray pattern. On the other hand, if the width m of the tapered surface 26 along the central axis of the air cap 16 exceeds 0.5 mm, the air flow entering the V shaped grooves 15 will be weak, and the coating material flow will form a center thick spray pattern, in which the ejection amount of the coating material is dense in the vicinity of a central axis of the coating material ejection opening 30A, while becoming sparser toward off the central axis. Therefore, the width m of the tapered surface 26 along the central axis of the air cap 16 is preferably set in the range of 0.1 mm to 0.5 mm.

Figure 13A:
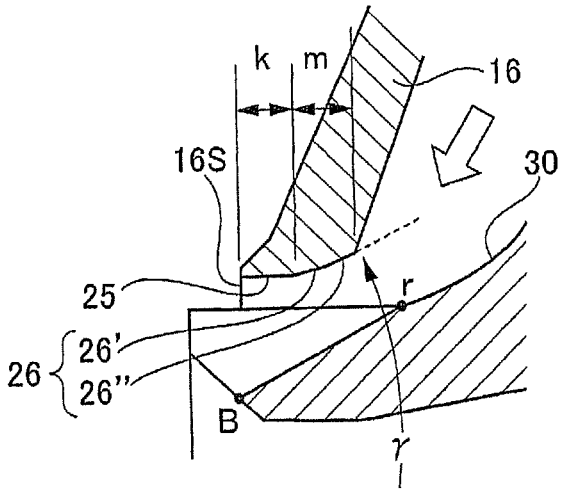
FIGS. 13A and 13B are configuration diagrams of a principal part of the spray gun according to respective modified examples of the fourth embodiment of the present invention.

Although the tapered surface 26 shown in FIG. 12 is a single tapered surface, there is no limitation thereto, and a multi tapered surface may be employed. FIG. 13A is an enlarged view of a part corresponding to a principal part of FIG. 12. In FIG. 13A, the tapered surface 26 is configured to be, for example, double tapered having tapered surfaces 26' and 26" in series. By configuring the tapered surface 26 multi tapered, the air flow will be smoother, and the spray pattern of the coating material flow can stably form the flat spray pattern. Here, the opening angle of the tapered surface 26 is defined to be an opening angle of a tapered surface (corresponding to the tapered surface 26" in the case of FIG. 13A)

positioned on a rear end side of the air cap 16. This is because the tapered surface positioned on the rear end side of the air cap 16 is adapted to change an orientation of the air flow, and the following tapered surface is only adapted to smooth the air flow.

Figure 13B:
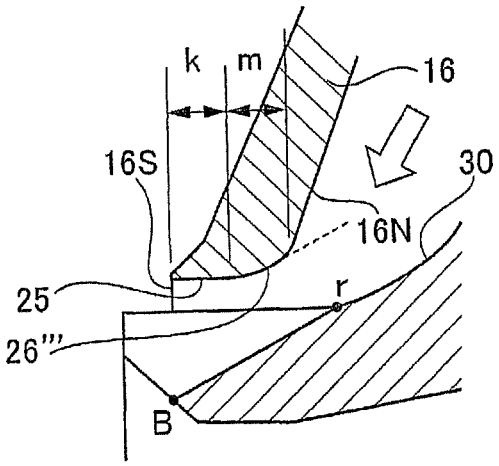

Furthermore, the tapered surface 26 may be configured to have a curved surface along a direction of the central axis of the air cap 16. FIG. 13B is an enlarged view of the part corresponding to the principal part of FIG. 12. In FIG. 13B, the tapered surface 26 (denoted by 26''' in FIG. 13B) is configured by the curved surface convex toward a side of the coating material nozzle 30. By configuring the tapered surface 26''' curved, the air flow will be smoother, and the spray pattern of the coating material flow can stably form the flat spray pattern. It is needless to mention that the tapered surface 26''' is not limited to the curved surface, and may be a tangential surface that connects the parallel surface 25 and a rear surface (denoted by 16N in FIG. 13B) of the air cap 16.

It is needless to mention that the configuration shown in the fourth embodiment can be employed in combination with any one of the above described first to third embodiments and the fifth embodiment, which will be described later.

Fifth Embodiment

Figure 14:
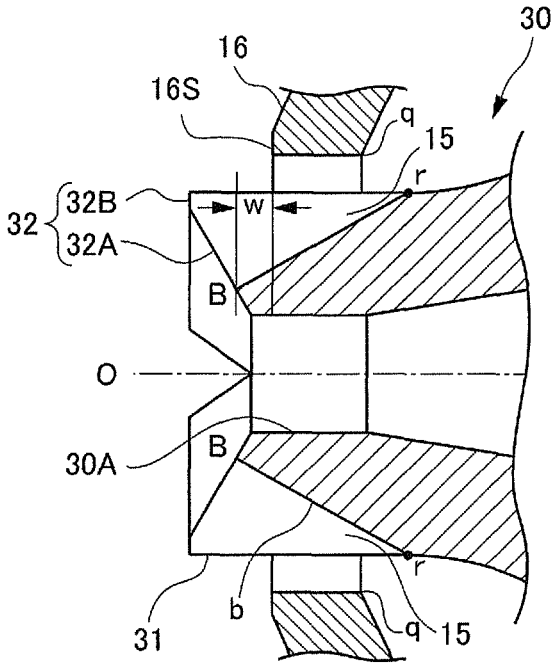
FIG. 14 is a cross sectional view of a tip end portion of a coating material nozzle together with an air cap showing a configuration of a principal part of a spray gun according to a fifth embodiment of the present invention.

FIG. 14 is a configuration diagram of a principal part of a spray gun 1 according to a fifth embodiment. FIG. 14 is a cross sectional view of a nozzle tip end portion 31 of a coating material nozzle 30 along with an air cap 16.

The coating material nozzle 30 and the air cap 16 are configured similarly to, for example, the configuration shown in the first embodiment.

Here, in relation to a front end surface 16S proximate to the coating material nozzle 30 of the air cap 16, a bottom (denoted by B in FIG. 14) of an open end of a V shaped groove 15 on a guide wall 32A of the coating material nozzle 30 is configured to be positioned between 0.5 mm ahead and 0.5 mm behind along a longitudinal direction of the nozzle tip end portion 31 of the coating material nozzle 30.

In the example of FIG. 14, the bottom B of the open end of the V shaped groove 15 on the guide wall 32A of the coating material nozzle 30 is positioned 0.5 mm ahead of the front end surface 16S of the air cap 16.

According to the spray gun 1 thus configured, it becomes possible to avoid adherence of coating material to the air cap 16 as well as to improve dispersion and atomization of the coating material. If, in relation to the front end surface 16S proximate to the coating material nozzle 30 of the air cap 16, the coating material nozzle 30 is configured to have the bottom B of the open end of the V shaped groove 15 on the guide wall 32A positioned backward along the longitudinal direction of the nozzle tip end portion 31 of the coating material nozzle 30, an air flow flowing in a coating material flow will increase, and the dispersion and atomization of the coating material will be improved.

However, in this case, since the coating material flow and the air flow are mixed in the vicinity of the air cap 16, it is difficult to avoid the air cap 16 from adherence of the coating material diffused from the coating material nozzle 30. Therefore, if, in relation to the front end surface 16S of the air cap 16, the coating material nozzle 30 is configured to have the bottom B of the open end of the V shaped groove 15 on the guide wall 32A positioned forward along the longitudinal direction of the nozzle tip end portion 31 of the coating material nozzle 30, it will be possible to avoid the adherence to the air cap 16 of the coating material diffused from the coating material nozzle 30.

In view of the above described trade-off, in the present embodiment, it is configured so that the bottom B of the open end of the V shaped groove 15 on the guide wall 32A is positioned between 0.5 mm ahead and 0.5 mm behind in relation to the front end surface 16S of the air cap 16 along the longitudinal direction of the nozzle tip end portion 31 of the coating material nozzle 30, thereby it becomes possible to avoid the adherence to the air cap 16 of the coating material, while improving the dispersion and atomization of the coating material.

It is needless to mention that the configuration shown in the fifth embodiment can be employed in combination with any one of the above described first to fourth embodiments.

It should be noted that the present invention is not limited to the scope described in the embodiments described above. It will be clear to those skilled in the art that modifications and improvements may be made to the embodiments described above. It should be noted that such modifications and improvements are included in the scope of the present invention.

REFERENCE SINGS LIST

1 spray gun (body)
2 gun barrel
3 trigger
3A fulcrum
4 grip part
5 air nipple
6, 6' air passage
7 air valve part
8 valve stem
9 air valve
10 guide chamber
11 needle valve guide
12 needle valve
13 coil spring
14 coating material joint
15 V shaped groove
16 air cap
16A horn portion
16S tip end surface (of the air cap)
18 air cap cover
19 slit (in a ring shape)
20 side air hole
21 auxiliary air hole
23 spread pattern adjustment device
24 pattern adjustment tab
25 parallel surface
26, 26', 26'', 26''' tapered surface
30 coating material nozzle
30A coating material ejection opening
31 nozzle tip end portion
32 tip end surface (of the coating material nozzle)
32A guide wall
32B flat portion

CITATION LIST

Patent Literature

Patent Literature 1: Japanese Unexamined Patent Application Publication No. 8-196950
Patent Literature 2: WO2001/002099

The invention claimed is:

1. A spray gun for mixing and atomizing a coating material flow and an air flow in the atmosphere, the spray gun comprising:

a body having a gun barrel;

a coating material nozzle disposed on a tip end side of the gun barrel, ejecting the coating material flow from a coating material ejection opening formed on a tip end surface thereof; and an air cap disposed on the tip end side of the gun barrel to surround a tip end portion of the coating material nozzle, the air cap defining a ring-shaped slit between an inner peripheral surface thereof and an outer peripheral surface of the tip end portion of the coating material nozzle to allow the air flow to be ejected therethrough, wherein the tip end portion of the coating material nozzle has on the tip end surface thereof an inner guide wall that widens along an axis extending in a first direction from an inner periphery of the coating material ejection opening toward a downstream facing surface of the coating material nozzle, the downstream facing surface extending in a second direction perpendicular to the first direction, the guide wall controlling the coating material flow ejected from the coating material ejection opening, the tip end portion also having on the outer peripheral surface thereof a plurality of V-shaped grooves channeled in a longitudinal direction from a rear end side thereof in a predetermined position toward the downstream facing surface, the V-shaped grooves extending through the tip end portion to define V-shaped notches in the inner guide wall, the V-shaped grooves inducing a part of the air flow ahead of the coating material ejection opening, wherein at least one of the V-shaped grooves has, in a triangle shaped cross section defined by contours crossing the guide wall, a height h in the range of 0.5 mm to 2.5 mm and an opening angle g of a bottom vertex in the range of 20 degrees to 100 degrees, and wherein the V-shaped grooves are formed with bottom portions located on a circle larger in diameter than an inner periphery of the coating material ejection opening on the guide wall of the coating material nozzle.

2. The spray gun according to claim 1, wherein at least one of the V-shaped grooves has an area of the triangle shaped cross section defined by contours crossing the guide wall in the range of 0.25 $mm^2$ to 1.00 $mm^2$.

3. The spray gun according to claim 1, wherein at least one of the V-shaped grooves has a length from the foremost of the tip end surface of the coating material nozzle to the rear end side thereof in the predetermined position along a central axis of the coating material nozzle in the range of 1.0 mm to 3.5 mm, and is also formed with a bottom portion having a convergence angle directing toward the tip end side of the coating material nozzle in the range of 30 degrees to 100 degrees.

4. The spray gun according to claim 1, wherein the coating material nozzle is formed with four V-shaped grooves, the V-shaped grooves being arranged to form a crisscross shape around the coating material ejection opening on the tip end surface of the coating material nozzle.

5. The spray gun according to claim 1, wherein the guide wall is in a conical shape having an opening angle in the range of 60 degrees to 150 degrees in side view.

6. The spray gun according to claim 1, wherein at least one of the V-shaped grooves is formed with a bottom portion located on the guide wall of the coating material nozzle between at 0.5 mm ahead and at 0.5 mm behind, in relation to a front surface proximate to the coating material nozzle of the air cap, in the longitudinal direction of the tip end portion of the coating material nozzle.

* * * * *